US009140511B2

(12) United States Patent
Michal et al.

(10) Patent No.: US 9,140,511 B2
(45) Date of Patent: Sep. 22, 2015

(54) BARREL AND SUPPRESSOR SLEEVES AND HEAT RESISTANT WEAPON ACCESSORIES

(71) Applicants: Frank J. Michal, Medina, OH (US); Michael E. Stein, New Philadelphia, OH (US)

(72) Inventors: Frank J. Michal, Medina, OH (US); Michael E. Stein, New Philadelphia, OH (US)

( * ) Notice: Subject to any disclaimer, the term of this patent is extended or adjusted under 35 U.S.C. 154(b) by 22 days.

(21) Appl. No.: 14/444,346

(22) Filed: Jul. 28, 2014

(65) Prior Publication Data

US 2015/0241159 A1 Aug. 27, 2015

Related U.S. Application Data

(63) Continuation-in-part of application No. 13/826,087, filed on Mar. 14, 2013, now abandoned.

(60) Provisional application No. 61/610,731, filed on Mar. 14, 2012.

(51) Int. Cl.
*F41A 15/00* (2006.01)
*F41A 21/30* (2006.01)

(52) U.S. Cl.
CPC ..... *F41A 21/30* (2013.01)

(58) Field of Classification Search
CPC ..... F41A 21/44
USPC ..... 42/96, 90; 89/14.2, 14.3, 14.4
See application file for complete search history.

(56) References Cited

U.S. PATENT DOCUMENTS

2012/0273083 A1* 11/2012 Lin ..... 138/140
2013/0283556 A1* 10/2013 Chen et al. ..... 15/168

* cited by examiner

*Primary Examiner* — J. Woodrow Eldred
(74) *Attorney, Agent, or Firm* — Black McCuskey Souers & Arbaugh, LPA

(57) ABSTRACT

Suppressor sleeves and gun barrel sleeves and covers have longitudinal interior splines and venting valleys and exterior ribs arranged at angles relative to the interior splines. One or more sleeves and caps are combined to provide suppressor sleeve assemblies and gun barrel covers and related weapon accessories.

15 Claims, 12 Drawing Sheets

BARREL AND SUPPRESSOR SLEEVES AND HEAT RESISTANT WEAPON ACCESSORIES

RELATED APPLICATIONS

This application is related to U.S. patent application Ser. No. 13/826,087, filed Mar. 14, 2013.

FIELD OF THE INVENTION

The present disclosure and related inventions are in the general field of firearms and firearm accessories.

BACKGROUND

Firearm suppressors or "silencers" are devices configured for attachment to a gun muzzle and designed to capture and divert the gases and air displaced from the muzzle of a barrel created by the explosive force of ammunition firing, and to thereby suppress the sound of the firing and reduce muzzle flash. The term "silencer" is defined by ATF as, "any device for silencing, muffling or diminishing the report of a portable firearm." Gun barrel and muzzle temperatures can reach 1500 degrees F. or greater under continuous firing or repetitious semi or fully automatic firing. Suppressors, which can be made of a variety of materials including weapons grade steel and alloys, are attached directly to the muzzle and may become heated to the same extent as the barrel and may retain additional heat energy in the baffle structures during repetitious rates of fire. In addition to being dangerous to touch when heated, suppressors are fully exposed to impact damage.

SUMMARY OF THE DISCLOSURE

The suppressor sleeves and heat resistant weapon accessories of the present disclosure are for use in combination with firearm suppressors, gun barrels and barrel muzzles, and gun grips and rails. As a representative embodiment, the suppressor sleeves and suppressor sleeve assemblies (also referred to herein individually and collectively as "SSA" or simply "suppressor sleeve" or "sleeve") of the present disclosure are used in conjunction with any weapon system's suppressor, silencer or "can" that is commonly attached to rifles, pistols, or other weapon platforms that utilize similar sound reducing devices. The suppressor sleeves and suppressor sleeve assemblies are used to insulate heat, reduce IR signature, and to minimize the mirage effect that the suppressor generates and emits during normal use. Since the suppressor sleeves are readily able to mitigate heat transfer to its external surface, they prevent operators from being burned during, or after, use of the weapon while the suppressor is still hot and the operator may be handling or coming in contact with the suppressor. The suppressor sleeves will also serve to protect the suppressor and other items that the suppressor may come in contact with, such as bags, gear or carrying cases, while the suppressor is still hot. The sleeves also help to further reduce noise and vibration of the weapon system during use. The sleeves will protect the suppressor itself from chemicals, abrasion and damage that can be caused by external hazards and will help to quiet the weapon during transport or when it inadvertently comes in contact with other objects.

The sleeves and sleeve assemblies are designed to be used both individually, and as a segmented series of sleeves that, when combined with other adjacent segments, can be "fit to length" to cover any partial length, or the entire length, of a gun barrel, barrel muzzle or suppressor as desired. When the sleeve assembly components are stacked together, they can either fit end to end or utilize an interlocking joint which seals off any escaping air or gasses that are generated by the suppressor. The sleeves are installed by sliding it onto and over the outside body diameter of the suppressor. The sleeves can be produced in any length or diameter necessary to fit any manufacturer's suppressor that it may interface with. The sleeves can stretch in any direction and will contour to the underlying surface in order to provide a secure fit. The insulating rings and gaps of the sleeve structure allow hot air to be cooled and diffused during use and can be present on the inside, outside or both inside and outside of the sleeve. The sleeve insulating ring fins, which may or may not appear on the external surfaces of the sleeve, will also aid to provide a firm and tactile grip that will reduce or eliminate any creep or movement of the sleeve once it is installed.

Any sleeve segment can be further cut to length to provide a precise fit and can also be used with optional end caps that utilize the same features and materials that the sleeve is made of. The sleeve can be made out of, but is not limited to, tactile heat resistant materials such as neoprene, silicone, flourosilicone or nano materials or combinations thereof. These materials resist heat, heat transfer, are flame retardant and/or flame proof, reduce or eliminate IR signature, are abrasion and chemical resistant, and also include the ability to use or incorporate varying colors and or camouflage patterns and components in the disclosed barrel and suppressor sleeves and weapon accessories.

DESCRIPTIONS OF THE DRAWING FIGURES

In the drawing Figures which constitute a part of this specification:

DETAILED DESCRIPTION OF PREFERRED AND ALTERNATE EMBODIMENTS

Figure 1:
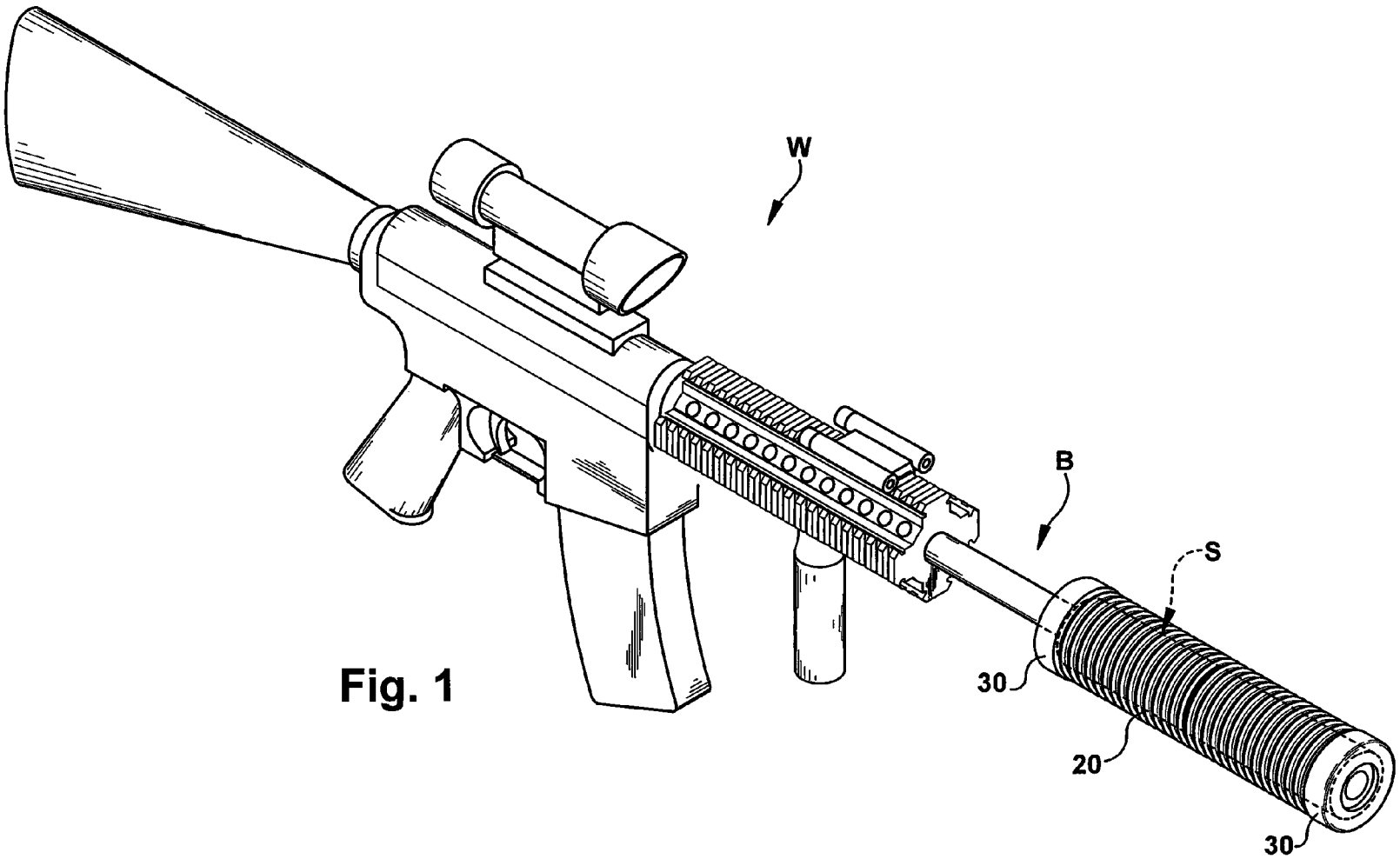
FIG. 1 is a perspective view of a firearm equipped with a suppressor and a suppressor sleeve assembly of the present disclosure.

With reference to FIG. 1, a representative weapon W has a barrel B equipped with a suppressor S (shown in phantom) which is substantially covered by a suppressor sleeve or sleeve assembly, indicated generally at 10. As illustrated in isolation in FIG. 2, a particular embodiment of the suppressor sleeve assembly 10 may include one or more sleeves 20, and one or more caps 30. The sleeves 20 can be manufactured in any nominal dimensions of outer diameter, inner diameter, wall thickness, length. Although the illustrated embodiment has a generally cylindrical configuration, other configurations are within the scope of the disclosure, such as for example a non-cylindrical exterior or interior surface with one or more planar surfaces. The sleeves 20 can be of any length, and with any suitable bore diameter for receiving a suppressor, barrel or barrel muzzle. As further described, the sleeves 20 can be alternatively configured as barrel sleeves, for direct application to the barrel or breech of gun or to other weapons such as mortar and grenade launching weapons. Accordingly, all of the disclosure and description of the sleeves 20 is applicable to sleeves for suppressors and sleeves for barrels, also referred to herein individually and collectively as "weapon sleeves".

As further illustrated in FIGS. 3-10, preferred embodiments of the sleeves 20 have one or more ribs or rings 22 which project from an exterior surface and are oriented generally radially and perpendicular with respect to a longitudinal axis of the sleeve. The ribs 22 may be of any thickness or profile and located at any spacing and extend or protrude from the sleeve wall 24 any suitable extent. Preferably the ribs 22 extend from sleeve wall 24 a sufficient distance to expose surface area of each rib for cooling and insulation efficiency. A representative thickness dimension of each rib 22 is 0.200 inches. A representative spacing between the ribs 22 is 0.250 inches. A representative thickness of the sleeve wall is 0.200 inches. Any of these and other representative dimensions may be increased or decreased for particular weapons, sleeve assemblies or applications, and varying heat dissipation capacities. Also, although the ribs 22 are depicted at ninety degree radials, i.e. orthogonal to the longitudinal axis of the sleeve 20, the ribs 22 may be arranged at any angle or angles relative to the longitudinal axis of the coil. The exterior profile of each rib may be generally rounded as illustrated, or of any other profile. Each individual rib 22 need not extend about the entire circumference of the exterior of wall 24 of the sleeve 20. And the number and spacing of ribs 22 on any sleeve 20 may vary.

As further illustrated in FIGS. 3-10, the interior of the sleeves 20 is configured with a plurality of radially arrayed longitudinal splines, indicated generally at 25. The longitudinal splines 25 (also referred to as "splines" or "flutes" or "heat dissipation channels") extend from the interior of sleeve wall 24 into the bore of the sleeve 20. An apex 26 of each spline is configured for contact with the outermost wall of a suppressor. The splines 25 are preferably equally radially arrayed as illustrated with venting valleys 27 between each spline. The splines may project from the sleeve wall 24 any suitable distance, and preferably a distance sufficient to create an air passageway between each apex 26. A representative dimension of a radial extent of the splines 25 from the interior wall of the sleeve wall 24 into the bore is 0.250 inches, but such dimension, as well as a nominal thickness of the splines may vary to any suitable dimension and configuration which creates a spatial gap between the sleeve wall 24 and an exterior surface of a suppressor or barrel, and preferably extend an entire axial length of the sleeve between each open end to create multiple open passages for gas and heat transfer. The venting valleys 27 extend the entire length of the sleeve 20. The splines 25 may be but do not have to be in a continuous radial array about the entire internal circumference of the interior of sleeve wall 24. For example, as shown in FIGS. 4, 6, 7 and 8, the internal configuration of the sleeve 20 may include a solid non-splined area 28, for example in the 10 o'clock to 2 o'clock positions, wherein the sleeve wall 24 fits substantially against the exterior of a suppressor which is attached to the muzzle end of a gun barrel. The configuration of the solid non-splined area increases the grip of the sleeve 20 upon the suppressor and reduces firing mirage or sight obscuration from firing gases and flash that may occur in that radial area during single round, or repetitive firing of a weapon, such as the sighting area down the top of the barrel. This same sleeve configuration with a non-splined area 28, also referred to as a "mirage block" can be used in any suppressor or barrel cover and is in fact a preferred configuration for a barrel cover because the mirage block 28 is in direct contact with the barrel from which the mirage heat radiates. Also, by locating the mirage block 28 on any upper or top area of a suppressor sleeve or barrel cover the IR signature is blocked from a wide area of locations above the weapon.

As noted, the sleeves 20 can be manufactured in any length, can be cut to any length after molding, and can be installed in combination with other sleeves 20 of any length. When multiple sleeves 20 are used in series as illustrated in FIG. 1, it is preferable, although not required, that the venting valleys 27 of the adjacent sleeves 20 are aligned. The sleeves 20 and sleeve assemblies substantially cover the exterior of a suppressor, including venting holes in the outermost wall of a suppressor, to thereby capture and re-direct firing gas and heat, and redirect and further muffle sound waves.

Figure 2:
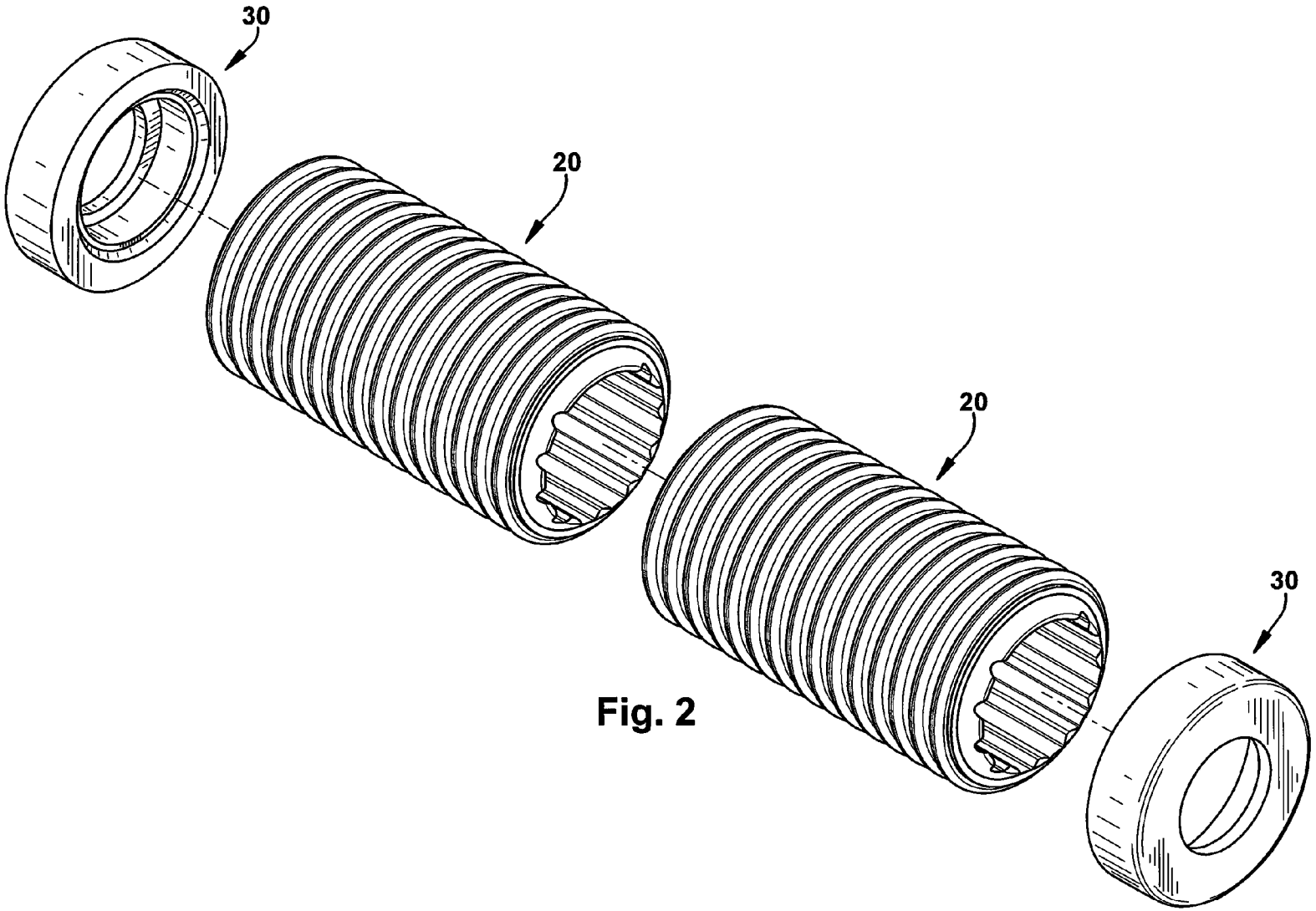
FIG. 2 is a perspective view of a representative embodiment of a suppressor sleeve assembly of the present disclosure.
Figure 3:
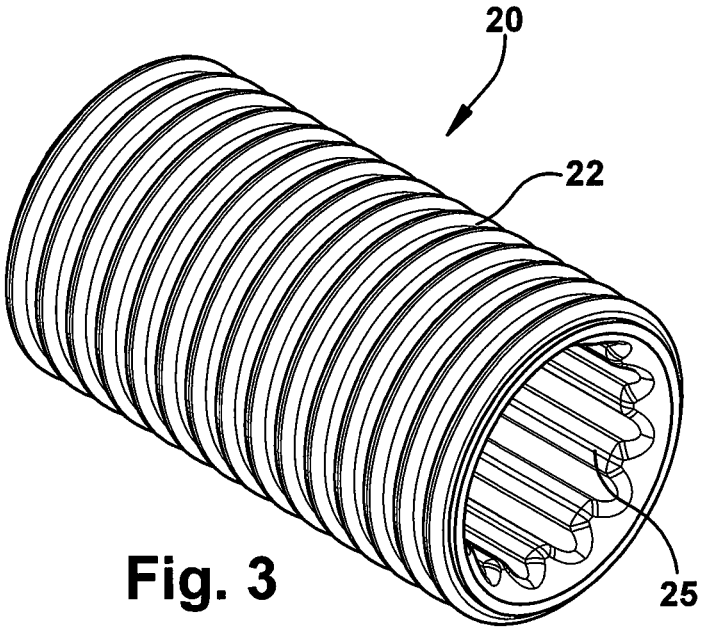
FIG. 3 is a perspective view of an embodiment of a suppressor sleeve of the present disclosure.
Figure 4:
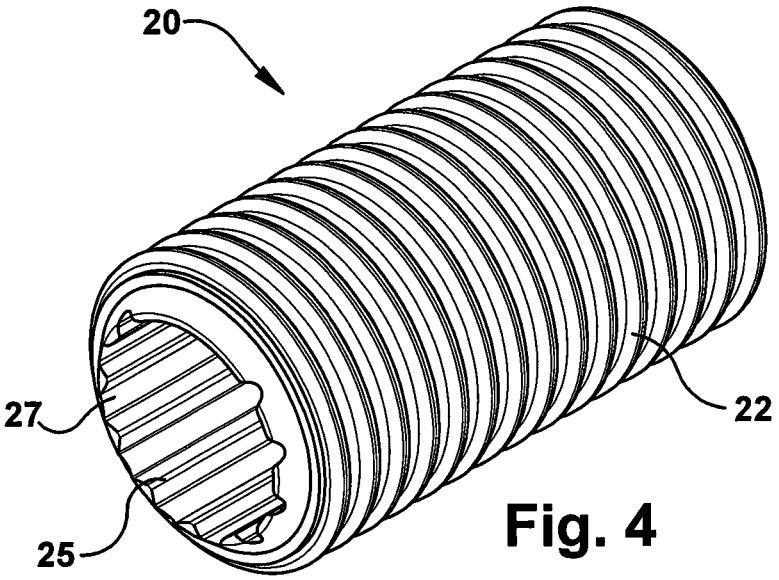
FIG. 4 is a perspective view of an alternate embodiment of a suppressor sleeve of the present disclosure.
Figure 5:
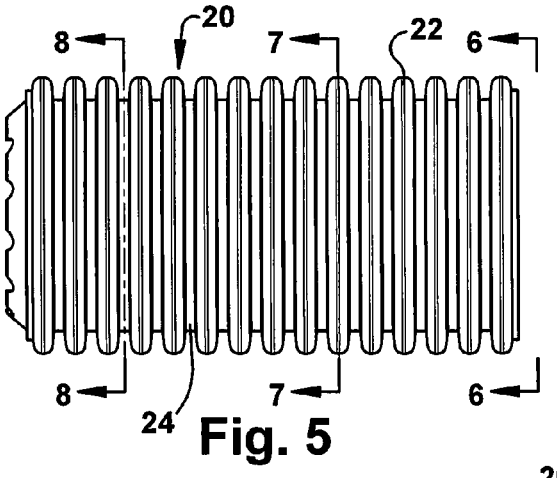
FIG. 5 is a profile view of a suppressor sleeve of the present disclosure.
Figure 6:
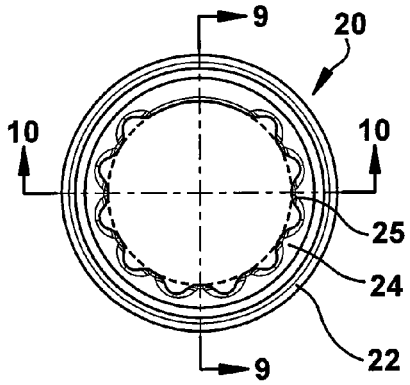
FIG. 6 is an end view of the suppressor sleeve of FIG. 5 illustrated from the direction of the arrows 6-6 in FIG. 5.
Figure 7:
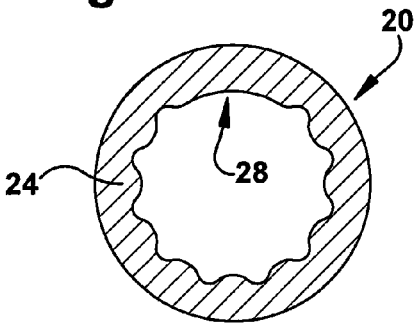
FIG. 7 is a cross-sectional view of the suppressor sleeve of FIG. 5 illustrated at the plane indicated at 7-7 in FIG. 5.
Figure 8:
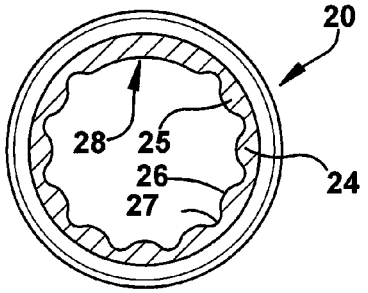
FIG. 8 is a cross-sectional view of the suppressor sleeve of FIG. 5 illustrated at the plane indicated at 8-8 in FIG. 5.
Figure 9:
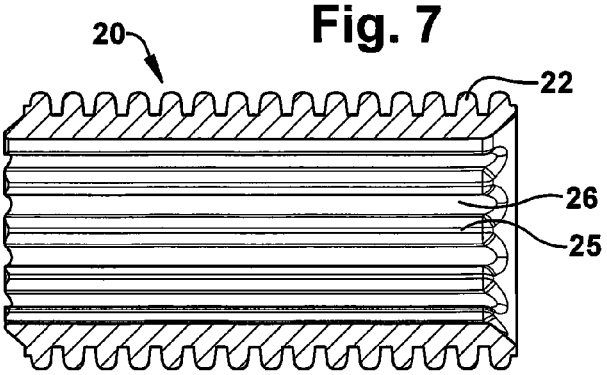
FIG. 9 is a cross-sectional view of the suppressor sleeve of FIG. 5 illustrated at the plane indicated at 9-9 in FIG. 6.
Figure 10:
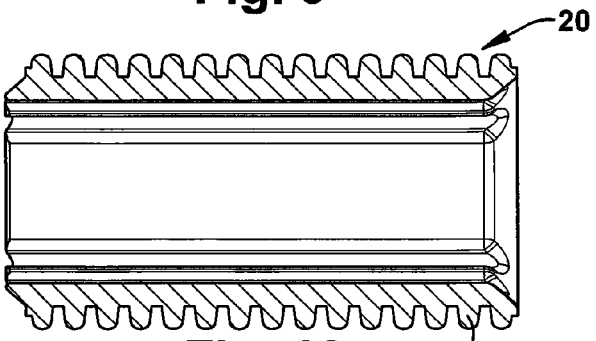
FIG. 10 is a cross-sectional view of the suppressor sleeve of FIG. 5 illustrated at the plane indicated 10-10 in FIG. 6.

As illustrated in FIGS. 1 and 2, the caps 30 can be selectively installed at either end of any arrangement of sleeves 20. Preferably, the cap 30 located at the muzzle end (proximate to the bullet exit point) does not occlude the venting passages formed by the venting valleys 27. Alternatively, the caps 30 can be molded integrally with the sleeves 20, or as separate attachable components, as for example by a band which extends around the sleeve.

The sleeves and suppressor sleeve assemblies of the disclosure are particularly effective at managing and re-directing the heat generated at a suppressor in order to maintain the exterior of the sleeve or sleeve assembly at non-dangerous or less dangerous temperatures to human touch or to inadvertent contact with other items or gear. The sleeves and sleeve assemblies accomplish this thermal management by the configuration of the venting valleys 27 which direct firing gases to the firing end of the suppressor, thereby reducing the amount of heat to radiate to the exterior of the suppressor. Heat which does radiate through the suppressor to and through the sleeve wall 24 is dissipated through and from the ribs 22. Temperatures are thereby lowest at the distal ends of the ribs 22. The combination of the internal splines 25 and external ribs, each with exposed surfaces, achieves maximum heat mitigation and transfer and heat insulation which allows bare hand handling of the sleeve 20 during or immediately after weapon operation. Further, the preferred materials from which the sleeves and sleeve assemblies are manufactured can be engineered to have excellent or superior heat resistant properties, such as for example compositions of silicone elastomers. To this end, the mass of the sleeves and sleeve assemblies directly contributes to the superior thermal management, and can be optimized by the various design parameters of sleeve wall thickness, rib thickness, width, height, number and placement; spline number, size and configuration and cap size.

The sleeves and sleeve assemblies can be molded from any suitable material. For example and without limitation, a material or blends of materials from which the sleeves and sleeve assemblies can be molded is preferably a high temperature reversion resistant silicone elastomer that has specific low thermal conductivity, e.g. max. of 00.29 W/m K, and without durometer degradation. A preferred material is high temperature reversion resistant silicone elastomer with no more than +/−20 point durometer change after heat aging for 6 hours at 316 C in a hot air circulating oven and a thermal conductivity maximum of 00.29 W*m/K. One example is a 50 durometer flourosilicone material. In general, silicone elastomers with high temperature and heat resistance and flame retardant properties are preferred. Such material in combination with the various embodiments of the sleeves and sleeve assemblies provides excellent and superior mitigation of heat transfer from the weapon to the exterior surfaces of the sleeves and sleeve assemblies, thereby allowing handling of the sleeve, sleeve assembly and suppressor much sooner after firing than without. The significant reduction in high-heat exposure allows a user to transition away from the use of the weapon, or to stow the weapon/suppressor away much sooner, without concern of burning their person or gear. Without the sleeves and sleeve assemblies of the disclosure, a long cooling period would typically be required for the suppressor before a user could safely or comfortably handle it. Furthermore, the sleeve and sleeve assemblies can be manufactured in different colors and exterior profile configurations which in addition to thermal, sound and light (firing flash) management completely conceal the suppressor. The same or similar configurations of the described sleeves can be installed on any portion of segment of a gun barrel or muzzle to achieve the described heat resistance, heat mitigation and related thermal management advantages.

Figure 11:
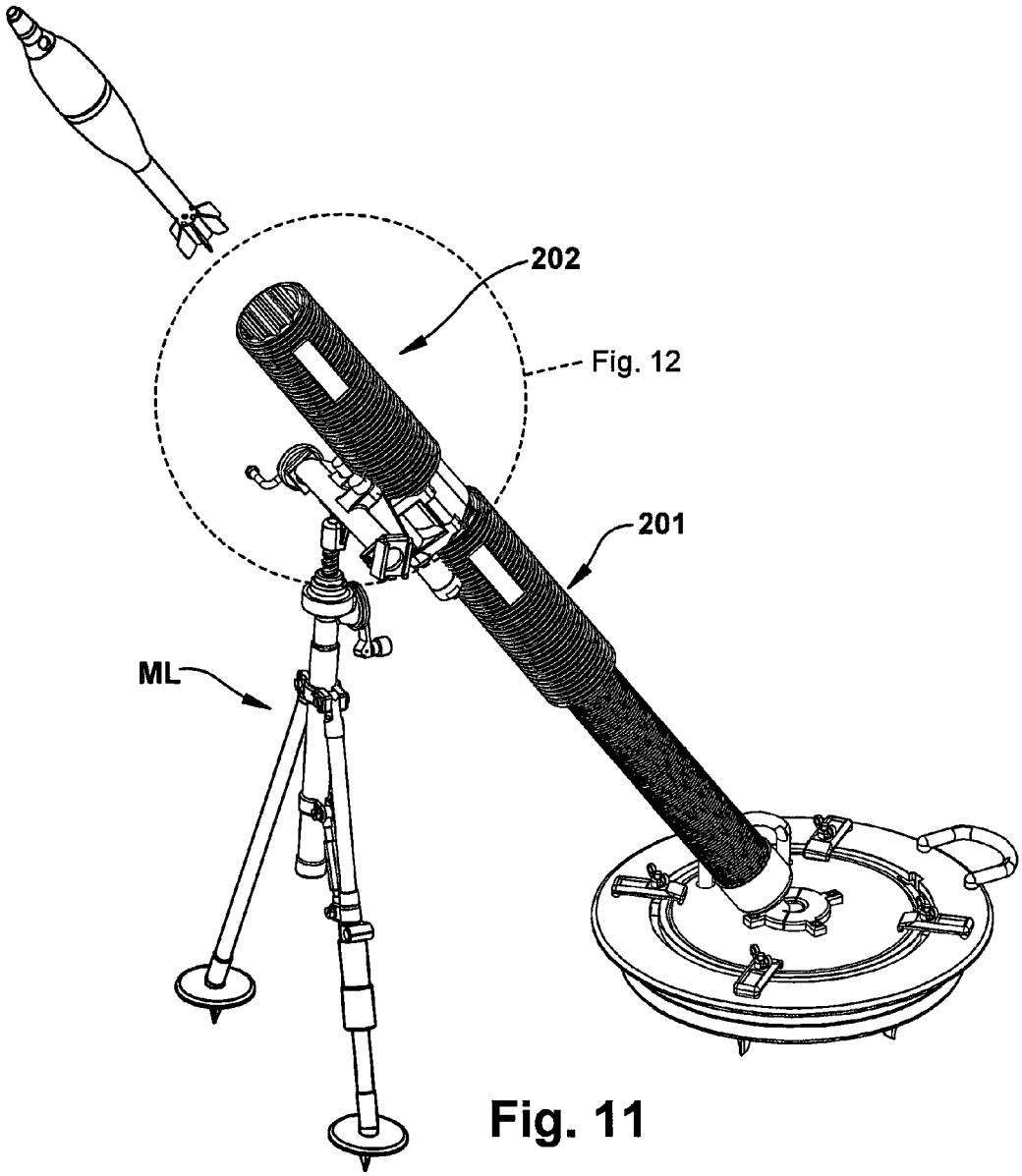
FIG. 11 is a perspective view of a mortar weapon outfitted with heat resistant accessories of the present disclosure.
Figure 12:
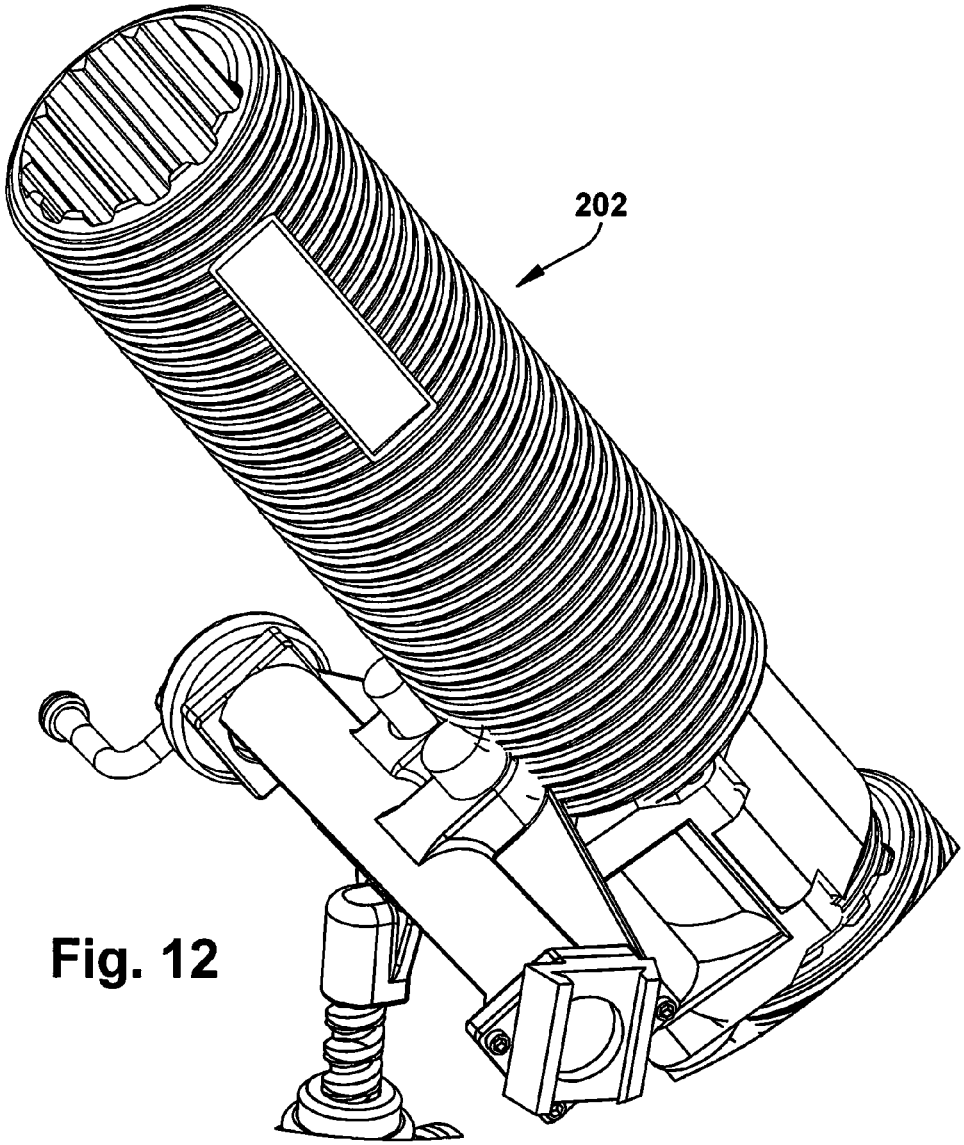
FIG. 12 illustrates a muzzle end of a mortar weapon outfitted with a heat resistant accessory of the present disclosure.
Figure 13:
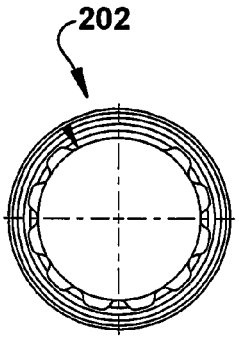
FIG. 13 is an end view of an embodiment of a heat resistant sleeve of the present disclosure.
Figure 14:
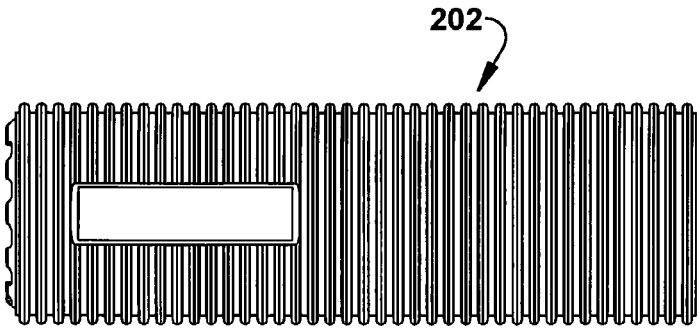
FIG. 14 is a side view of an embodiment of a heat resistant sleeve of the present disclosure.

FIG. 11 illustrates an alternate embodiment of a heat resistant weapon sleeve of the present disclosure, which is adapted for use in connection with a projectile launching type weapon such as a mortar launcher ML as illustrated, with a first sleeve 201 installed on the barrel of the mortar launcher, and a second sleeve 202 installed on the muzzle of the mortar launcher, for example forward of the bipod. The sleeves 201, 202 can be of the same general configuration as described, and as further illustrated in FIGS. 12-14. The provision of two separate sleeves 201, 202 allows the mortar launcher to be safely handled during and between firings and for transport or repositioning.

Figure 15:
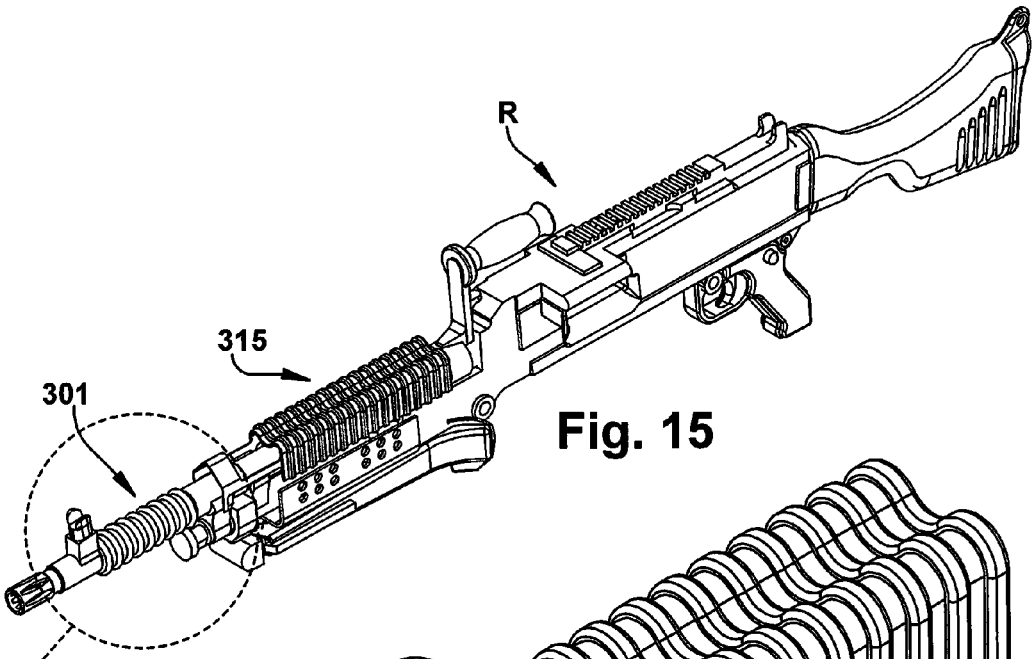
FIG. 15 is a perspective view of a firearm weapon outfitted with heat resistant accessories of the present disclosure.
Figure 16:
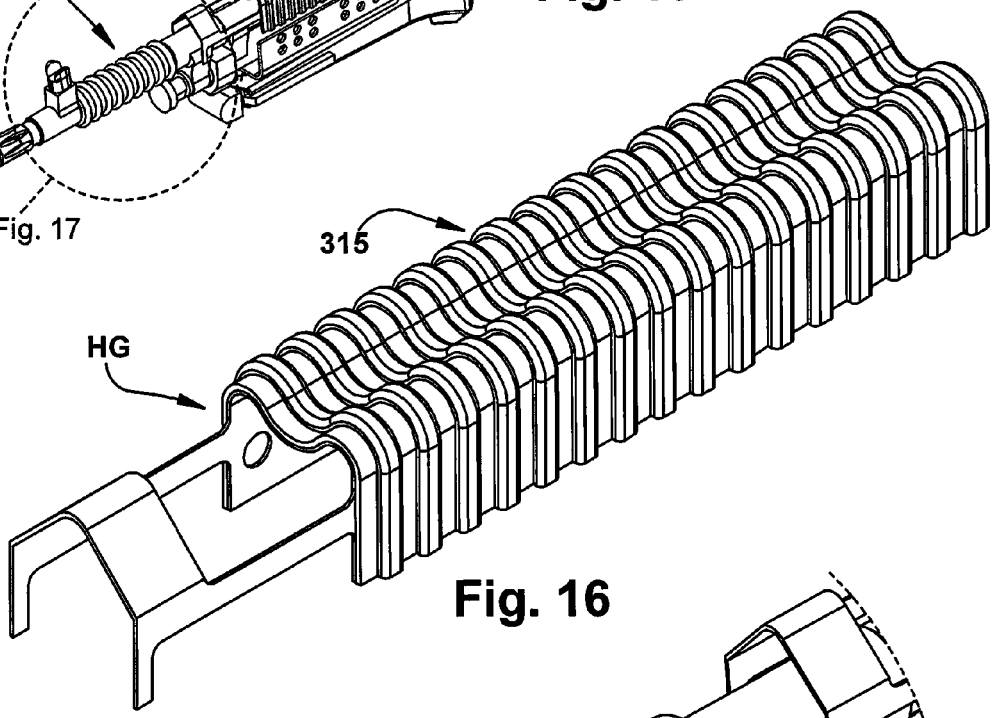
FIG. 16 is a perspective view of a heat resistant firearm grip of the present disclosure.
Figure 17:
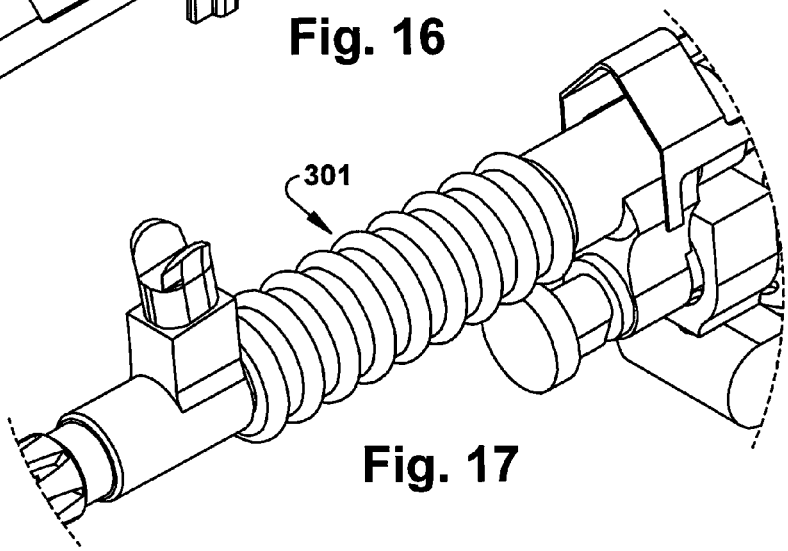
FIG. 17 is a perspective view of a barrel sleeve of the present disclosure.
Figure 18:
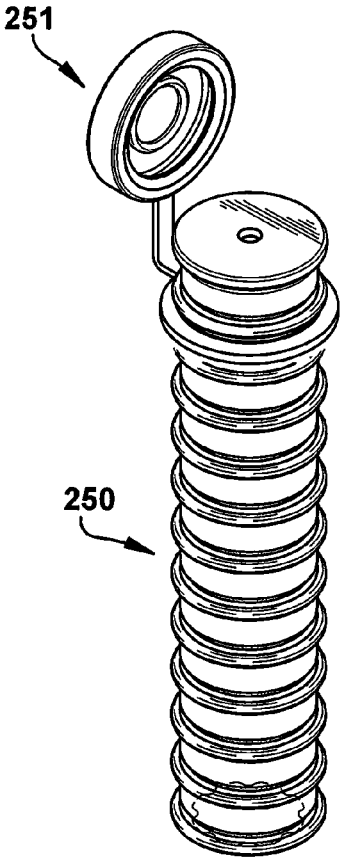
FIG. 18 is a perspective view of an embodiment of a weapon sleeve and cap of the present disclosure.
Figure 19:
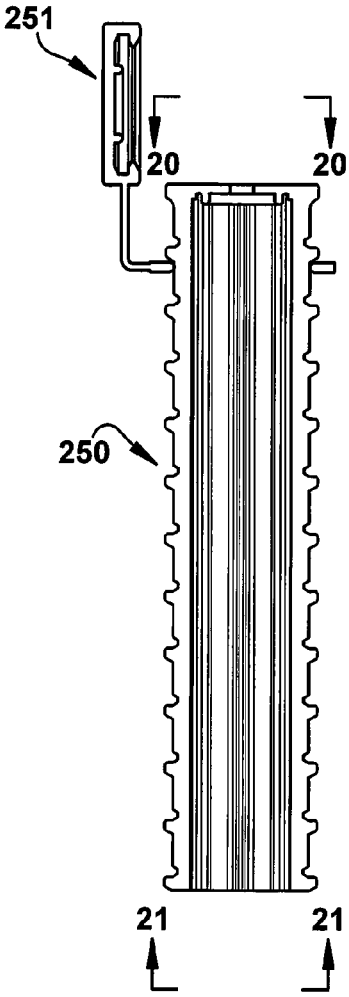
FIG. 19 is a cross-sectional view of the weapon sleeve and cap of FIG. 18.
Figure 20:
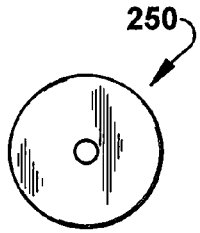
FIG. 20 is an end view of the weapon sleeve of FIG. 19, as indicated.
Figure 21:
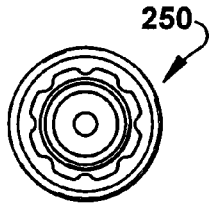
FIG. 21 is an end view of the weapon sleeve of FIG. 19, as indicated.
Figure 22:
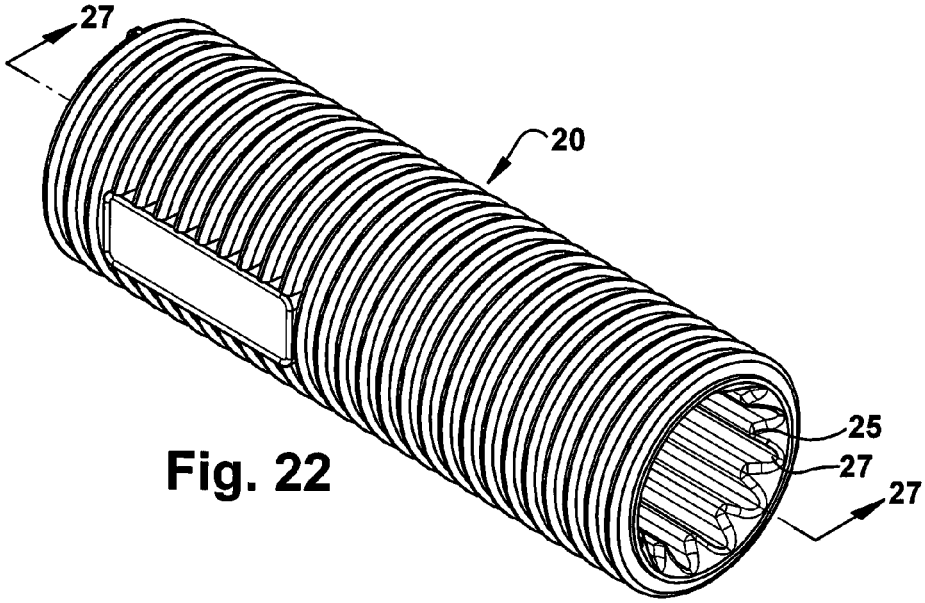
FIG. 22 is a perspective view of an embodiment of a weapon sleeve of the present disclosure.
Figure 23:
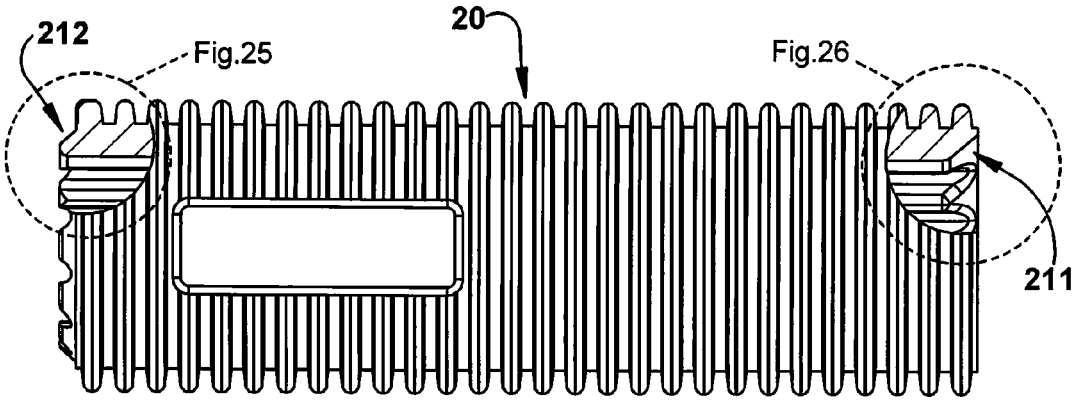
FIG. 23 is a side view of the weapon sleeve of FIG. 22.
Figure 24:
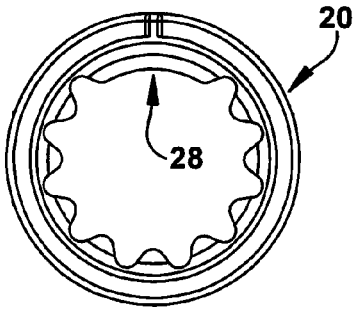
FIG. 24 is an end view of the weapon sleeve of FIG. 22.
Figure 25:
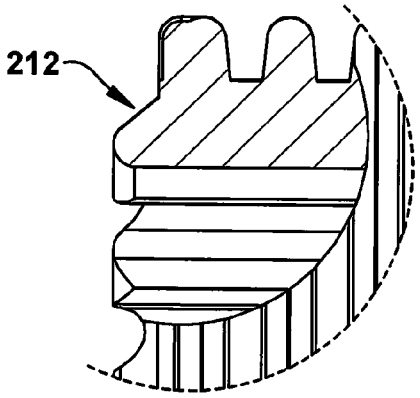
FIG. 25 is an enlarged view of the portion of the weapon sleeve as indicated on FIG. 23.
Figure 26:
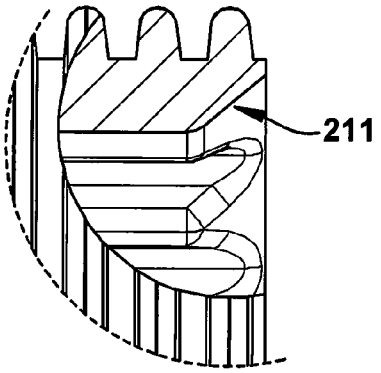
FIG. 26 is an enlarged view of the portion of the weapon sleeve as indicated on FIG. 23.
Figure 27:
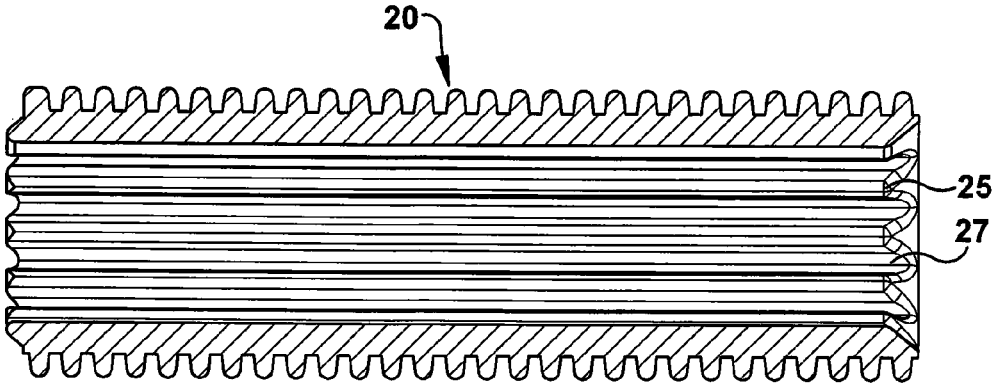
FIG. 27 is a cross-sectional view of the weapon sleeve of FIG. 22, as indicated thereon.

FIG. 15 illustrates alternate embodiments of heat resistant sleeves and shields configured for use with different types of firearms R such as for example the M240, M249, SAW, M60 weapon platforms or similar weapon platforms, wherein a barrel sleeve 301 is configured for installation on an otherwise exposed section of the barrel which extends forward from the fore end grip and to the muzzle end and sight mount. The barrel sleeve 301 may have the same general configuration and features as the previously described sleeves and all of the attendant benefits of heat mitigation, heat mirage blocking and reduction or elimination of IR signature. Also, the barrel sleeves 301 can be installed by the original equipment manufacturer, for example prior to installation of the barrel on to the gun.

Also in connection with any particular weapon platform such as the referenced rifles and carbines, a heat resistant grip 315 can be molded directly to a fore end hand grip HG, to cover the metal of the hand grip, provide a superior gripping material, and block migration of heat from the barrel and IR signature. The grip 315 in combination with the barrel sleeve 301 is particularly effective at heat management and IR signature reduction.

FIGS. 18-21 illustrate an alternate embodiment of a suppressor sleeve 250 with cap 251 which can be integrally molded with or attached to the exterior of the suppressor sleeve at the exit end. The cap is advantageous for storage protection of the suppressor and barrel bores against environmental contamination.

Figure 28:
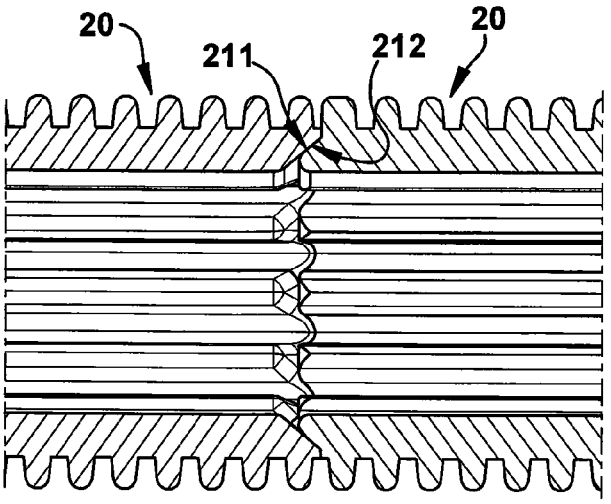
FIG. 28 is a cross-sectional view of mating weapon sleeves of the present disclosure.
Figure 29:
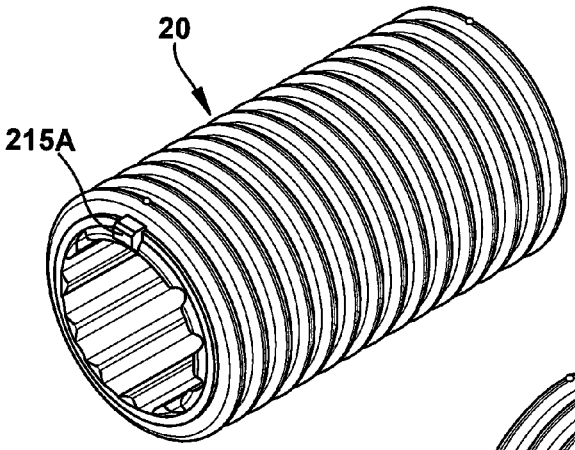
FIG. 29 is a perspective view of an alternate embodiment of a weapon sleeve of the present disclosure.
Figure 30:
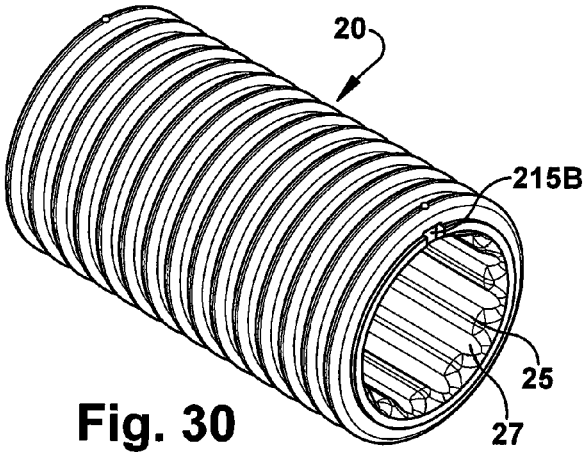
FIG. 30 is an alternate perspective view of the weapon sleeve of FIG. 29.
Figure 31:
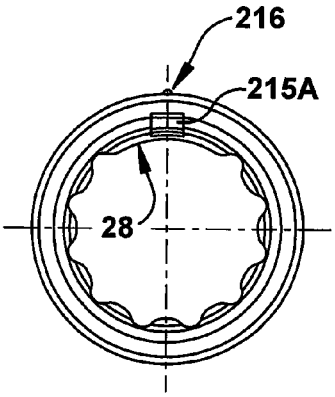
FIG. 31 is an end view of an alternate embodiment of a weapon sleeve of the present disclosure.
Figure 32:
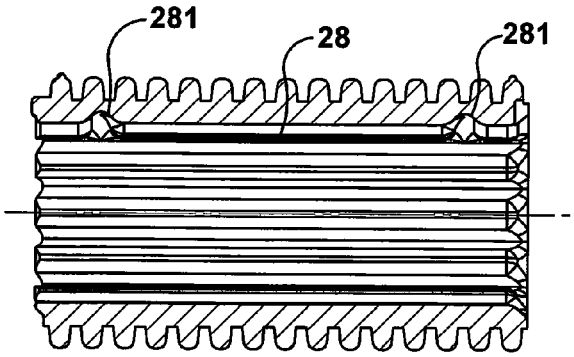
FIG. 32 is a cross-sectional view of an alternate embodiment of a weapon sleeve of the present disclosure.
Figure 33:
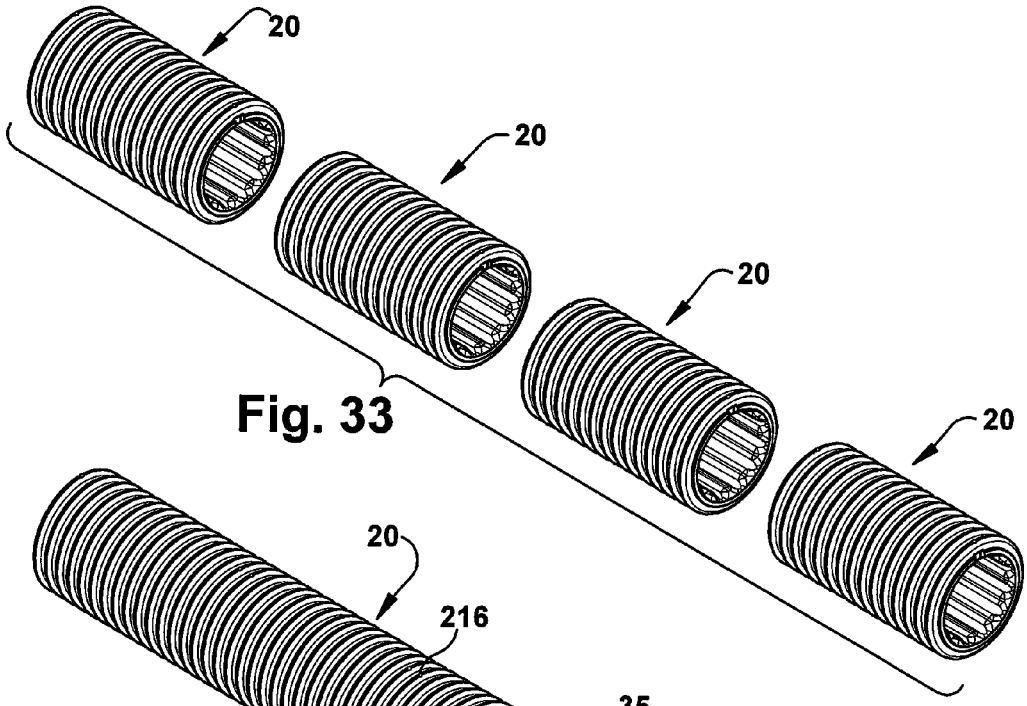
FIG. 33 is a perspective assembly view of a connectable series of weapon sleeves of the present disclosure.
Figure 34:
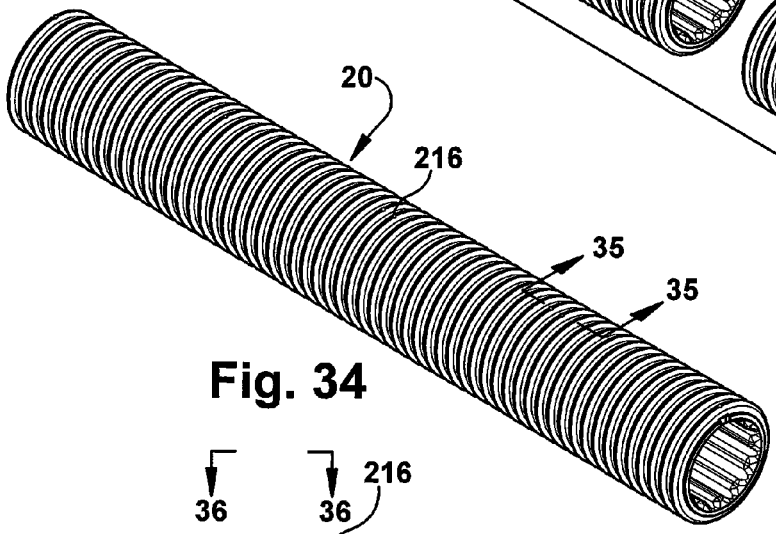
FIG. 34 is a perspective view of a weapon sleeve assembled from the serially connected weapon sleeve components of FIG. 33.
Figure 35:
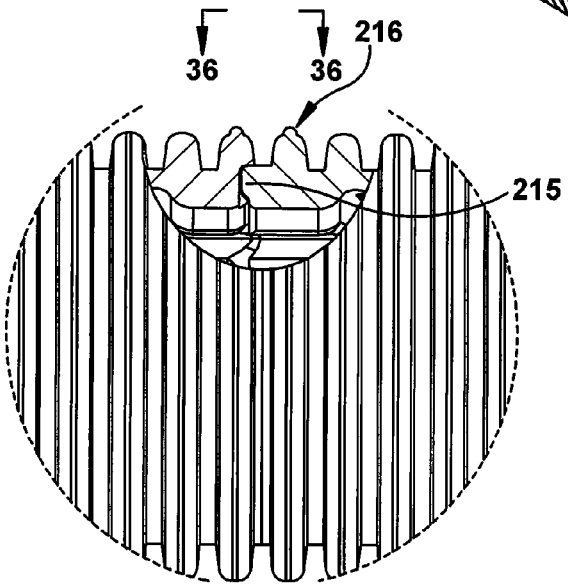
FIG. 35 is an enlarged and partial cutaway view of a mating area of the weapon sleeve components of FIG. 33.
Figure 36:
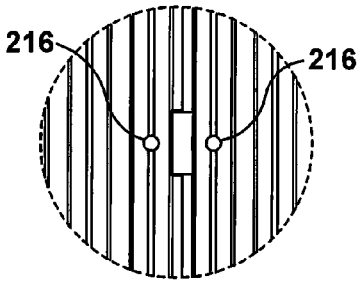
FIG. 36 is an enlarged view of serially connected weapon sleeve components.

FIGS. 22-28 illustrate alternate embodiments of sleeves 20 with various configurations for installation in series on any suppressor or barrel of any length, as shown for example in FIG. 2 and FIG. 33, illustrated assembled in FIG. 34. Mating ends of the sleeves 20 may be beveled for example at 211, 212 to create a tight overlapping fit, as shown in FIG. 28, of consecutive sleeves 20 in a serial installation, with splines 25 and valleys 27 of each sleeve axially for the described venting operation. An optional index tab and detent 215A, 215B may be provided for such alignment of the splines 25, and further optionally with external alignment indicators 216, further illustrated in FIGS. 34-36. And as illustrated in FIG. 32, cross-vents 281 may be formed in or proximate to the mirage block area 28 in order to further facilitate gas flow and heat transfer.

Any of the various described suppressor sleeves 20 can be manufactured separately and then combined with a suppressor (or installed on a suppressor), individually or in series as described, or manufactured with a suppressor such as by insert or over-molding as known in the art, or otherwise formed integrally with a suppressor as a permanent or removable component of the exterior configuration of the suppressor.

What is claimed is:

1. A suppressor sleeve for attachment to a firearm suppressor having a generally cylindrical configuration and a cylindrical external surface, the suppressor sleeve comprising:

a generally cylindrical body having a first end and a second end;

an internal bore in the generally cylindrical body configured to receive and fit about an exterior of a suppressor, the internal bore defining a continuous unperforated wall of the generally cylindrical body;

a plurality of radially arrayed and spaced apart splines located on an interior of the internal bore and arranged parallel to a longitudinal axis of the generally cylindrical body, each of the splines having an apex configured for contact with an external surface of a firearm suppressor, and a venting valley between each of the splines extending from the first end to the second end of the generally cylindrical body;

a plurality of ribs which extend from an exterior surface of the generally cylindrical body.

2. The suppressor sleeve of claim 1 wherein the plurality of ribs located on an exterior of the generally cylindrical body are arranged generally perpendicular to the longitudinal axis of the generally cylindrical body.

3. The suppressor sleeve of claim 1 further comprising a solid area on the interior of the internal bore intermediate the splines.

4. The suppressor sleeve of claim 1 wherein the splines extend from the first end to the second end of the generally cylindrical body.

5. The suppressor sleeve of claim 1 wherein the splines are spaced radially at a distance sufficient to create a space between adjacent splines.

6. The suppressor sleeve of claim 1 wherein the splines extend from the internal bore a distance sufficient to create a space between the internal bore and a surface of a suppressor.

7. The suppressor sleeve of claim 1 wherein a cross-sectional profile of the splines differs from a cross-sectional profile of the ribs.

8. The suppressor sleeve of claim 1 wherein a radial extent of the splines is greater than a radial extent of the ribs.

9. The suppressor sleeve of claim 1 in combination with a suppressor having a generally cylindrical outer surface, and distal ends of the splines in contact with the outer surface of the suppressor.

10. The suppressor sleeve of claim 9 wherein the suppressor sleeve extends over a substantial length of the suppressor.

11. The suppressor sleeve of claim 1 further comprising beveled edges at the first and second ends of the generally cylindrical body.

12. The suppressor sleeve of claim 1 further comprising an index tab located at the first or second end of the generally cylindrical body.

13. The suppressor sleeve of claim 1 further comprising an index detent located at a first or second end of the generally cylindrical body.

14. The suppressor sleeve of claim 1 installed on a firearm suppressor.

15. A firearm suppressor cover in combination with a firearm suppressor, the firearm suppressor being generally cylindrical and having a cylindrical outer surface, the firearm suppressor cover having a generally cylindrical wall;

a plurality of radially arrayed and spaced apart splines located on an interior of the internal bore and arranged parallel to a longitudinal axis of the generally cylindrical body, each of the splines having an apex configured in contact with the cylindrical outer surface of the firearm suppressor, and a venting valley between each of the splines extending from the first end to the second end of the generally cylindrical body;

and a plurality of ribs which extend from an exterior surface of the generally cylindrical wall of the firearm suppressor cover.

* * * * *